US006655475B1

(12) United States Patent
Wald

(10) Patent No.: US 6,655,475 B1
(45) Date of Patent: Dec. 2, 2003

(54) PRODUCT AND METHOD FOR TREATING WELL BORES

(76) Inventor: H. Lester Wald, 804 W. Cabillo Way, Mustang, OK (US) 73064

( * ) Notice: Subject to any disclaimer, the term of this patent is extended or adjusted under 35 U.S.C. 154(b) by 42 days.

(21) Appl. No.: 10/035,531

(22) Filed: Nov. 9, 2001

Related U.S. Application Data

(60) Provisional application No. 60/263,969, filed on Jan. 23, 2001.

(51) Int. Cl.[7] ..... E21B 33/13

(52) U.S. Cl. ..... 175/64; 175/72; 175/309; 166/117; 166/285

(58) Field of Search ..... 175/72, 64, 65, 175/308, 309, 68; 166/162, 117, 285; 206/524.7

(56) References Cited

U.S. PATENT DOCUMENTS

| | | | | |
|---|---|---|---|---|
| 2,836,555 A | | 5/1958 | Armentrout | |
| 3,175,628 A | * | 3/1965 | Dellinger | 175/72 |
| 3,417,824 A | * | 12/1968 | Poollen | 175/72 |
| 3,921,733 A | | 11/1975 | Clampitt | |
| 4,068,676 A | | 1/1978 | Thorn et al. | |
| 4,078,612 A | | 3/1978 | Gallus | |
| 4,187,909 A | | 2/1980 | Erbstoesser | |
| 4,191,254 A | | 3/1980 | Baughman et al. | |
| 4,285,398 A | | 8/1981 | Zandmer et al. | |
| 4,510,998 A | | 4/1985 | Peiffer et al. | |
| 4,542,791 A | | 9/1985 | Drake et al. | |
| 4,611,664 A | * | 9/1986 | Osterhoudt et al. | 166/162 |
| 4,664,816 A | | 5/1987 | Walker | |
| 4,675,348 A | * | 6/1987 | Martischius et al. | 507/225 |
| 4,704,213 A | | 11/1987 | Delhommer et al. | |
| 4,749,498 A | | 6/1988 | Lange et al. | |
| 4,836,940 A | | 6/1989 | Alexander | |
| 4,890,675 A | | 1/1990 | Dew | |
| 5,611,400 A | | 3/1997 | James et al. | |
| 5,715,896 A | | 2/1998 | Naraghi | |
| 5,810,085 A | | 9/1998 | James et al. | |
| 6,009,946 A | | 1/2000 | McKelvey | |

OTHER PUBLICATIONS

Allied Colloids Inc, Alcomer 110RD, Material Safety Data Sheet (3 pages), Jul. 30, 1993, Suffolk, VA.

Hydro Foam Technology, DI Tube, Material Safety Data Sheet (2 pages), undated, but published prior to Applicant's filing date, Stillwater, OK.

* cited by examiner

*Primary Examiner*—David Bagnell
*Assistant Examiner*—Matthew J. Smith
(74) *Attorney, Agent, or Firm*—Mary M. Lee

(57) ABSTRACT

A product, system and method for treating a well bore using a concentrated treatment composition enclosed in a soluble container. The composition-filled container is deposited in the well, preferably through the drill string, followed by a solvent, such as drilling mud or water, to form a circulating solution characterized by the ability to circulate through the well. Most of the circulating solution is recovered at the surface using a mud tank, for example. In a well "sweeping" operation a partially hydrolyzed polyacrylamide powder in a soluble tube is dropped down the drill string. The well bore is then flushed with water or drilling mud to form the liquified polymer down hole. The well is flushed with more water or mud to sweep the cuttings and polymer solution from the well bore.

35 Claims, 2 Drawing Sheets

PRODUCT AND METHOD FOR TREATING WELL BORES

This application claims the benefit of the filing date of U.S. provisional application Ser. No. 60/263,969, filed Jan. 23, 2001, entitled "Product and Method for Treating Well Bores."

FIELD OF THE INVENTION

The present invention relates generally to oil, gas and water wells and, more particularly, but without limitation, to products and methods for treating well bores during drilling and completion.

BACKGROUND OF THE INVENTION

Oil and gas well bores typically are made by drilling down into a formation using rotary-driven drill bits. This process generates cuttings that must be flushed or swept from the well to maximize efficiency of the drilling operation. Conventionally, this sweeping process has been carried out by pouring a liquefied polymer composition down through the drill string. Other well treatments involve the introduction of a treatment composition into the well bore from the surface. For example, sometimes during the drilling process, it is desirable to introduce agents to act as preservatives, caustics, and/or corrosion inhibitors.

Where these treatment chemicals and compositions are liquid, the introduction of the liquid through the drill pipe is often problematic. For example, in the case of liquid polymers, spillage frequently occurs around the rig floor and near the mud pits and the mud pump. This makes the work area hazardous because the liquid is so slippery. Moreover, spillage results in waste. Still further, most of the treatment compositions are introduced using water or other solvents, which reduces the concentration and the efficiency of the compositions.

SUMMARY OF THE INVENTION

The present invention comprises a well treatment product for use in a well bore with a treatment solvent. The product comprises a concentrated well treatment composition. The composition is soluble in the solvent to form a circulating solution. The circulating solution formed is characterized by the ability to circulate through the well bore. The product further comprises a container enclosing the composition. The container is sized to be received in the well bore and is at least partially soluble in the solvent to release the composition.

Further, the present invention comprises a method for treating a well bore. The method comprises depositing in the well bore from the surface an effective amount of a treatment composition. The treatment composition is soluble in a selected solvent to form a circulating solution characterized by the ability to circulate through the well bore. When it is deposited, the treatment composition is enclosed in a container that is at least partially soluble in the selected solvent. An effective amount of the selected solvent is deposited in the well bore to dissolve the treatment composition and form the circulating solution. The circulating solution is circulated through the well bore, and a significant portion of the circulating solution is recovered at the surface.

Still further, the present invention includes a system for treating a well bore. The system comprises an elongate conduit sized to be inserted down the well bore. Also included in the system are a solvent, and a container enclosing a treatment composition. The container is sized to be received in the conduit and is characterized by being at least partially soluble in the solvent. The treatment composition is soluble in the solvent to form a circulating solution characterized by the ability to circulate through the well bore.

DETAILED DESCRIPTION OF THE PREFERRED EMBODIMENT

Figure 1:
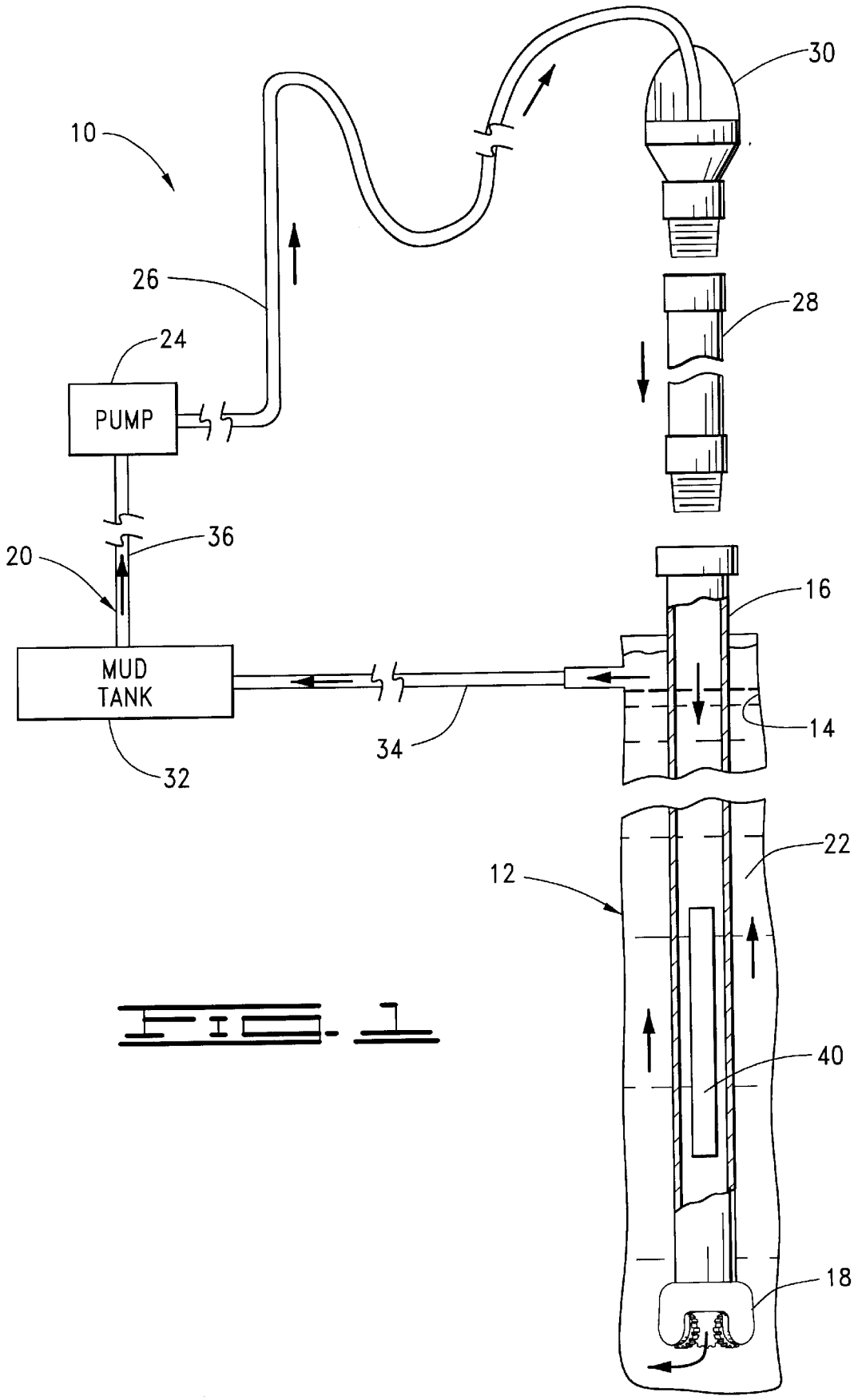
FIG. 1 is a semi-schematic view of a system comprising the well treatment product of the present invention.

Turning now to the drawings in general and to FIG. 1 in particular, there is shown therein a well treatment system 10 in accordance with one embodiment of the present invention. The system 10 services a well 12 comprising a well bore 14. As used herein, "well" refers to any subterranean well including but not limited to oil and gas wells. As shown, the system 10 includes an elongate conduit, such as the drill string 16. A rotary bit 18 is operatively attached at the end of the drill string 16, and the drill string is driven by a rig (not shown).

The system 10 preferably includes a fluid circulation assembly 20 for circulating fluid, such as drilling mud 22, down the drill string 16 and up through the well bore 14 outside the drill string. The fluid circulation assembly 20 preferably includes a pump 24 fluidly connected to the drill string 16 by a conduit 26 to pump the fluid being circulated down the drill string 16. A Kelly 28 and a swivel 30 usually are included. Because the fluid 22 returning from the bottom of the well bore 14 near the bit 18 is likely to contain cuttings and other solids, it will usually be desirable to include in the fluid circulation assembly 20 a filtering device, such as a mud tank 32. The fluid 22 returning from the well bore 14 is directed through the flow line 34 to the mud tank 32. From the mud tank 32, the fluid 22 is returned to the pump 24 through the conduit 36, and cycle is repeated. Now it will be seen that in this system 10, drilling mud 22 or other fluids can be continuously circulated through the bottom of the well bore 14.

Figure 2:
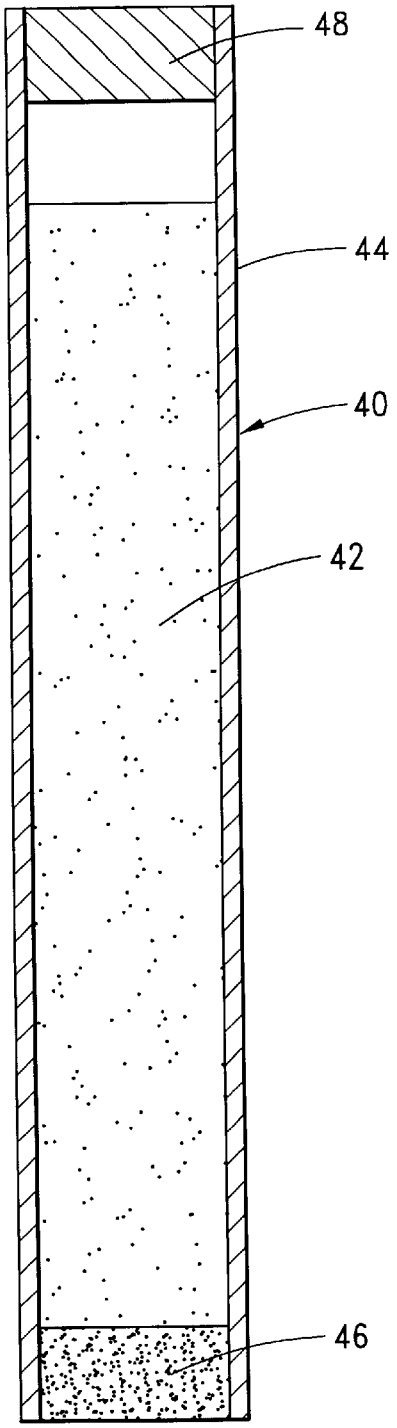
FIG. 2 is a longitudinal sectional view of a product made in accordance with the present invention and comprising a treatment composition in particulate form.

In the practice of the present invention, the system 10 further comprises a well treatment product 40 for use in the well bore 14. As shown in FIG. 2, to which attention now is directed, the product 40 comprises a treatment composition 42 inside a container 44. The treatment composition 42 is selected depending on the nature of the treatment to be applied to the well bore 14. For example, the treatment may be sweeping the well bore or introducing an anti-corrosive or caustic agent, and the treatment composition will vary accordingly.

Where the selected treatment is sweeping the well bore 14, a preferred treatment composition 42 is a polymer agent. Preferably, the polymer used in this application is a partially hydrolyzed polyacrylamide ("PHA") concentrated in a powdered or particulate form. One suitable composition is a copolymer of sodium acrylate and acrylamide, such as the composition sold under the brand name ALCOMER 110RD by Allied Colloids, Inc. (Suffolk, Va.). This polymer also acts as a bentonite extender or viscosifier in low solids, nondispersed muds or floculate, and settles solids in clear water drilling. The polymer used in this invention may also aid in minimizing bit and stabilizer balling in soft or gumbo shales. When liquified, this polymer is a relatively viscous fluid capable of encapsulating drill cuttings and stabilizing shale in a well bore, and yet is fluid enough to be circulated repeatedly through the well bore 14. "Shale stabilization" means the ability of the polymer to adsorb onto cuttings and clays clinging to the borehole, thus preventing dispersion.

It will be appreciated that the system 10 includes a solvent. In the sweeping system illustrated herein, the solvent is the water-based drilling mud 22 (FIG. 1). Alternately, the solvent could be water, as the polymer agent is soluble in both. However, the solvent may vary widely depending on the selected treatment composition.

In the preferred system 10, the composition 42 is soluble in the drilling mud 22 to form a circulating solution characterized by the ability to circulate through the well bore 14. As used herein, "circulate" used in reference to the circulating solution denotes a fluid of a character and viscosity that it can flow freely down the drill string 16 and back up through the well bore 14 for recycling through the fluid circulating assembly 20. While this encompasses a variety of composition/solvent combinations, it excludes swellable compositions designed to swell down hole in the presence of mud or water for the purpose of plugging a well or borehole, instead of circulating through the well bore. It is understood, of course, that a certain amount of the circulating solution necessarily will remain in the well bore in order to have the desired effect. However, the amount effective for treating the well bore in accordance with this invention is not sufficient to block or plug the well bore.

As used herein, "solution" and "solvent" are not limited to the strict chemical definitions of the terms. Rather, these terms are used herein to denote any fluid composition, including a suspensions, emulsions, and mixtures as well as a true solutions, capable of being circulated through the well bore.

Referring still to FIG. 2, the container 44 is sized to be received in the well bore 14 and to contain an effective amount of the treatment composition 42. The container may be rigid or flexible and may take various shapes and sizes. For example, the container may be one or more spheres, capsules or tubes, and may be circular or non-circular in cross-section. In the preferred form shown in the drawings, the container 44 is an elongate, cylindrical tube.

The container 44 is formed at least partially of material that is soluble in the selected solvent to release the treatment composition 42 down hole. For example, the container may be made entirely of a soluble material or be formed with openings or pores filled with soluble plugs. Thus, "soluble" when used to describe the container 44 means at least partially soluble when exposed to the selected solvent.

In the embodiment described herein for sweeping a well bore during drilling, the container 44 preferably is an elongate tube formed of a soluble polymer soap composition that dissolves entirely in the presence of drilling mud or water down hole. Such soluble tubes are available under the brand name "DI" tube from Hydro Foam Technology (Stillwater, Okla.). The DI brand tube is about 15 inches long and about 1 inch in diameter. It comes with one open end and one end closed by a salt plug 46. The open end may be closed by a soap plug 48, or in some other suitable manner, after the container 44 is filled with the treatment composition 42.

Figure 3:
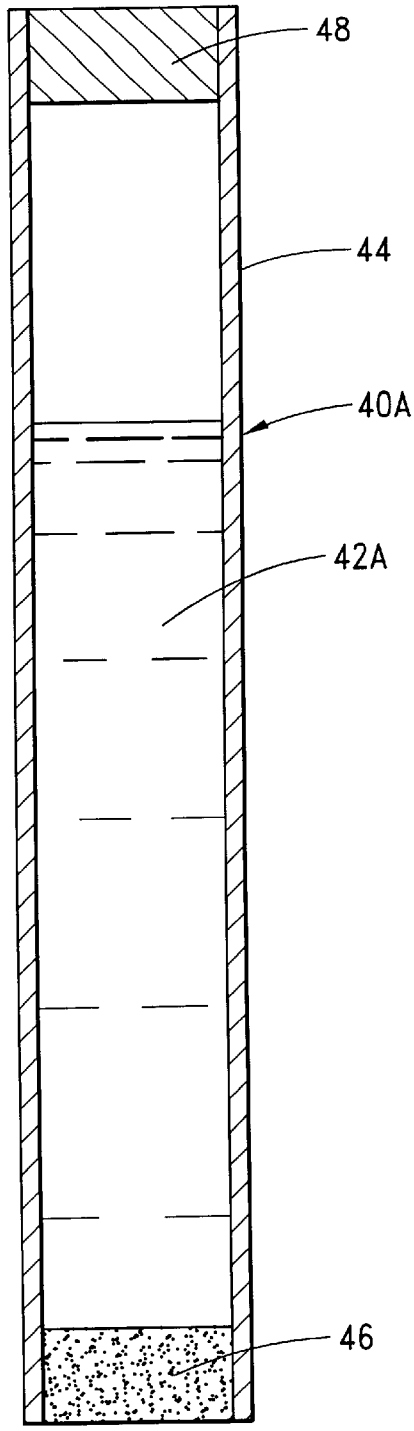
FIG. 3 is a longitudinal sectional view of a product made in accordance with the present invention and comprising a liquid as the treatment composition.

Turning now to FIG. 3, there is shown therein an alternate embodiment of the well treatment product designated by the reference numeral 40A. The product 40A comprises a container 44 similar to the container 44 of the embodiment of FIG. 2. However, the composition 42A is in a concentrated liquid form instead of a powdered or particulate form, as in FIG. 2.

In accordance with the method of the present invention, a well bore can be treated. First, returning to FIG. 1, an effective amount of a treatment composition 42 is deposited in the well bore 14 from the surface of the well 12. The treatment composition, such as a polymer agent for sweeping as well as described previously, is soluble in a selected solvent, such as the drilling mud 22. When mixed with the solvent, the combined solvent and composition form a circulating solution, such as a drilling mud mixed with diluted, liquefied polymer agent, that is characterized by the ability to be circulated through the well bore.

In the practice of this method, when the treatment composition is deposited in the well bore, it is enclosed in a container that is at least partially soluble in the solvent. A preferred container, as described above, is DI brand tube formed of soap.

Having deposited the composition-filled container in the well bore, an effective amount of the selected solvent, such as drilling mud or water, is deposited in the well bore to dissolve the composition and form the circulating solution. It will be understood that the well bore may already contain fluid, such as drilling mud, that is to be used as the solvent.

Where the application is sweeping a well bore during the early phase (e.g., the first 5000 feet), the composition-filled container comprising the treatment product 40 may be introduced by simply dropping it down the drill string 16 (FIG. 1), and it will sink to the bottom of the well bore 14. Once the product 40 reaches the drill bit 18 it will be dissolved in the drilling mud 22. The liquefied polymer or other treatment composition is forced through the orifices in the drill bit and is flushed back up hole by continued circulation of the drilling mud 22 in which it becomes diluted.

While in the embodiment described herein the treatment product 40 is introduced into the well bore 14 through the drill string 16, other methods may be used to deposit the product. It may be dropped loose into an empty well bore, or it may be lowered at the end of a cable, or deposited in any other suitable manner.

The circulating solution is circulated through the well bore to expose the well bore to the solution to produce the desired effect. For this purpose, the circulating assembly 20 described herein will suffice. After the treatment is completed, a significant portion of the circulating solution is recovered from the well at the surface.

Now it will be appreciated that the present invention provides an improved product, system and method for the treatment of well bores during the drilling phase with circulating solutions. A treatment product comprising a powdered or concentrated liquid form of a treatment composition is placed inside a soluble container that will dissolve down hole to allow the treatment composition to escape through the drill bit into the well bore and form a diluted circulating solution. Thus, the process of introducing the composition is simplified and made safer and more efficient and consequently less costly. Because the treatment composition is introduced in a container, there is no spillage of slippery or hazardous materials. Because the treatment composition may be in a powdered or concentrated form, efficiency of the composition is improved; that is, a greater concentration per volume of material is provided.

Changes can be made in the combination and arrangement of the various parts and steps described herein without departing from the spirit and scope of the invention.

What is claimed is:

1. A well treatment product for use with a treatment solvent in an elongate conduit in a well bore, the product comprising:

a concentrated well treatment composition soluble in the treatment solvent to form a circulating solution characterized by the ability to circulate through the well;

a container enclosing the composition, wherein the container is adapted to be deposited in the conduit at the surface and passed down through the elongate conduit, and wherein the container is inert to the treatment composition and is at least partially soluble in the treatment solvent to release the composition in the conduit and to form the treatment solution inside the conduit.

2. The product of claim 1 wherein the composition comprises a polymer.

3. The product of claim 1 wherein the composition comprises a partially hydrolyzed polyacrylamide.

4. The product of claim 1 wherein the composition comprises a partially hydrolyzed polyacrylamide in particulate form.

5. The product of claim 1 wherein the composition comprises a copolymer of sodium acrylate and acrylamide in particulate form.

6. The product of claim 5 wherein the solvent is drilling mud.

7. The product of claim 6 wherein the container is formed entirely of material that is soluble in the solvent.

8. The product of claim 7 wherein the container is an elongate cylindrical tube.

9. The product of claim 1 wherein the solvent comprises drilling mud.

10. The product of claim 1 wherein the container is formed entirely of material that is soluble in the solvent.

11. A method for treating a well bore comprising:

depositing in the well bore from the surface through an elongate conduit an effective amount of a treatment composition that is soluble in a selected solvent to form a circulating solution characterized by the ability to circulate through the well bore, wherein the treatment composition is enclosed in a container that is inert to the treatment composition and that is at least partially soluble in the selected solvent;

depositing an effective amount of the selected solvent in the well bore through the elongate conduit to decompose the container and dissolve the treatment composition inside the conduit and form the circulating solution therein;

circulating the circulating solution down through the conduit and back up through the annular space between the conduit and the well bore; and recovering a significant portion of the circulating solution at the surface.

12. The method of claim 11 wherein the elongate conduit is a drill string with a drill bit on the end.

13. The method of claim 12 wherein the treatment composition comprises a polymer.

14. The method of claim 13 wherein the treatment composition comprises a partially hydrolyzed polyacrylamide.

15. The method of claim 14 wherein the treatment composition comprises a copolymer of sodium acrylate and acrylamide in particulate form.

16. The method of claim 15 wherein the container is formed entirely of material that is soluble in the selected solvent.

17. The method of claim 16 wherein the selected solvent comprises drilling mud.

18. The method of claim 11 wherein the selected solvent comprises drilling mud.

19. The method of claim 18 wherein the circulating solution is recovered using a circulating assembly.

20. The method of claim 11 wherein the circulating solution is circulated and recovered using a circulating assembly.

21. The method of claim 11 wherein the treatment composition comprises a copolymer of sodium acrylate and acrylamide in particulate form.

22. The method of claim 11 wherein the container is formed entirely of material that is soluble in the solvent.

23. A system for treating a well bore, the system comprising:

an elongate conduit sized to be inserted down the well bore;

a solvent;

a container sized to be received in the conduit and characterized in that it is at least partially soluble in the solvent while in the conduit; and a treatment composition in the container the composition characterized as soluble in the solvent while in the conduit to form a circulating solution therein, wherein the circulating solution is characterized by the ability to circulate down through the conduit and up through the annular space between the conduit and the well;

wherein the container is inert to the treatment composition.

24. The system of claim 23 wherein the treatment composition comprises a polymer.

25. The system of claim 23 wherein the treatment composition comprises a partially hydrolyzed polyacrylamide.

26. The system of claim 23 wherein the treatment composition comprises a partially hydrolyzed polyacrylamide in particulate form.

27. The system of claim 23 wherein the treatment composition comprises a copolymer of sodium acrylate and acrylamide in particulate form.

28. The system of claim 27 wherein the solvent comprises drilling mud.

29. The system of claim 23 wherein the solvent comprises drilling mud.

30. The system of claim 29 wherein the container is further characterized as formed entirely of material that is soluble in the solvent.

31. The system of claim 30 wherein the container is an elongate, cylindrical tube.

32. The system of claim 23 wherein the container is further characterized as formed entirely of material that is soluble in the solvent.

33. The system of claim 23 wherein the container is an elongate, cylindrical tube.

34. The system of claim 23 further comprising an elongate conduit positioned in the well bore, a fluid circulating pump fluidly connected to the well bore near the surface to receive circulating solution returning from the well bore and fluidly connected to the elongate conduit to deliver circulating solution to the bottom of the well bore.

35. The system of claim 34 wherein the elongate conduit is a drill string, wherein the solvent is drilling mud, wherein the treatment composition comprises a copolymer of sodium acrylate and acrylamide in particulate form, and wherein the container is formed entirely of material that is soluble in the solvent.

* * * * *